US006752300B2

(12) United States Patent
Har-Shen

(10) Patent No.: US 6,752,300 B2
(45) Date of Patent: Jun. 22, 2004

(54) HOLSTER FOR A HANDGUN

(75) Inventor: Chanan Har-Shen, Kfar Hess (IL)

(73) Assignee: Fobus International Ltd., Kfar Hess (IL)

( * ) Notice: Subject to any disclaimer, the term of this patent is extended or adjusted under 35 U.S.C. 154(b) by 63 days.

(21) Appl. No.: 10/165,386

(22) Filed: Jun. 6, 2002

(65) Prior Publication Data

US 2003/0226866 A1 Dec. 11, 2003

(51) Int. Cl.[7] ..... F41C 33/02
(52) U.S. Cl. ..... 224/244; 224/911
(58) Field of Search ..... 224/243, 244, 224/911, 912

(56) References Cited

U.S. PATENT DOCUMENTS

| | | | | | |
|---|---|---|---|---|---|
| 1,635,984 | A | * | 7/1927 | Corriston | 224/244 |
| 1,641,439 | A | * | 9/1927 | Jovino | 224/244 |
| 2,551,913 | A | * | 5/1951 | Toby | 224/244 |
| 4,925,075 | A | * | 5/1990 | Rogers | 224/244 |
| 4,934,574 | A | * | 6/1990 | Salandre | 224/244 |
| 4,971,236 | A | | 11/1990 | Grummet | |
| 5,176,302 | A | | 1/1993 | Smith | |
| 5,303,860 | A | | 4/1994 | Serafini, Jr. | |
| 5,322,200 | A | | 6/1994 | Blanchard | |
| 5,551,611 | A | | 9/1996 | Gilmore | |
| 5,573,157 | A | * | 11/1996 | Mauriello et al. | 224/244 |
| 5,810,221 | A | * | 9/1998 | Beletsky et al. | 224/244 |
| 5,865,357 | A | | 2/1999 | Goodwin | |
| 6,161,741 | A | | 12/2000 | French | |

* cited by examiner

*Primary Examiner*—Nathan J. Newhouse
(74) *Attorney, Agent, or Firm*—Fulbright & Jaworski LLP

(57) ABSTRACT

The invention provides a top-draw security holster for a handgun having a trigger guard of the type wherein the security holster is orientated for wearing by a user and comprises a holster body having an inner and an outer side wall, an open top, a back and an at least partially-closed and non-opening front wherein a holster cavity is defined in said holster body characterized in that said security holster is provided with a flexible U-shaped latch control means having an inner arm and an outer arm bracketing a trigger guard receiving area of said holster cavity, wherein said inner arm is provided with an integral boss, which in the relaxed state of said latch control means extends into the trigger guard cavity of a handgun inserted in said holster body preventing drawing said handgun therefrom and said outer arm projects outwardly from said outer side wall of said holster body, wherein movement of said outer arm towards said holster in turn moves said inner arm away from said trigger guard thereby allowing the drawing of said handgun from said holster cavity in a straight upward motion through the open top of said holster body.

2 Claims, 3 Drawing Sheets

HOLSTER FOR A HANDGUN

FIELD OF INVENTION

The present invention relates to handgun holsters.

More particularly, the invention provides a security catch for a rigid plastic holster which catch prevents an assailant from taking the handgun, yet provides practically no impediment to fast drawing of the weapon by its legitimate user.

BACKGROUND OF THE INVENTION

The present invention is a modification of and an improvement on the invention described in Israel Specification No. 129,683 and corresponding U.S. application Ser. No. 09/546,506 the teachings of which are hereby incorporated by reference in the present application.

The advantages of the rigid plastic handgun holster, typically comprising of three injection molded castings joined together, have been explained in the above-mentioned specification. In particular the advantages of the rigid holster over the conventional leather item include quicker draw and a more stable handgun orientation. The former patent did not however refer to a security device intended to prevent accidental loss of the weapon or its seizure by a hostile person. Protection against such eventualities is known to be important to users, who will agree to pay a little extra for a holster having some form of security catch.

There is little difficulty in preventing withdrawal of a handgun from a holster by application of one of many known locking devices. These however do not allow for a fast draw in case the user experiences sudden danger from an unanticipated encounter. For police officers and other persons carrying out dangerous missions, the difference between fast and slow weapon deployment can decide the chance of survival.

Prior art devices are disclosed in the following US Patents.

Hamby, in U.S. Pat. No. 3,866,811 discloses a spring-release sliding latch to be released by the user pushing a lever for a partial revolution. The device if not kept clean and oiled is likely to jam so as to prevent the spring releasing the latch.

Atkins describes a safety device relying on hook and loop fastener tabs in the nylon fabric holster described in U.S. Pat. No. 4,480,776. Before weapon withdrawal the user must separate the tabs by running a thumb therebetween. In view of this, It is doubted whether fast withdrawal is possible.

U.S. Pat. No. 4,750,655 to Barry discloses a holding strap assembly on a gun holster offering three degrees of security at the cost of extended draw times for the more secure modes. Use of the device may well require user instructions. The strap assembly employs hook and loop fastening pads.

Adjustability is also offered by the locking system proposed by Young in U.S. Pat. No. 4,858,799. A rotary control allows for setting to a fully locked position as well as various degrees of force needed to remove the gun from its holster. The problem is that gun owners can not know in advance when there will arise a sudden need for self defense; a securely locked weapon at such a time can be fatal.

A break-open front is a feature of the holster disclosed by Grummet in U.S. Pat. No. 4,971,236. The holster is restrained by a strap. A strap release device is provided as part of the holster. Release of the handgun thus requires two consecutive actions.

Solenoid activated lock release is featured in U.S. Pat. No. 5,449,103 to Tilley. The obvious problem is that mobile power sources and switching devices become unreliable after an extended time period, so that the weapon may be unavailable when needed.

The limitations of prior art holster security devices illustrate that not surprisingly a higher degree of security is paid for by decreased release reliability and longer draw time. There is the further consideration that the cost of many of the prior art devices—for example the electrically-releasable lock proposed by Tilley—are unacceptable where the same end can be achieved at much lower cost and for less added weight.

It is therefore one of the objects of the present invention to obviate the disadvantages of prior art security holsters and to provide a gun retention device which allows for the fastest possible release.

It is a further object of the present invention to provide such a fast-release device at a cost which is practically insignificant relative to the cost of the holster assembly itself.

The present invention achieves the above objects by providing a top-draw security holster for a handgun having a trigger guard of the type wherein the security holster is orientated for wearing by a user. The holster body has an inner and an outer side wall, an open top, a back and an at least partially-closed and non-opening front wherein a holster cavity is defined in the holster body characterized in that the security holster is provided with a flexible U-shaped latch control means having an inner arm and an outer arm bracketing a trigger guard receiving area of the holster cavity, wherein the inner arm is provided with an integral boss.

In the relaxed state, the latch control means extends into the trigger guard cavity of a handgun inserted in the holster body preventing drawing the handgun therefrom. The outer arm projects outwardly from the outer side wall of the holster body. Movement of the outer arm towards the holster in turn moves the inner arm away from the trigger guard thereby allowing the drawing of the handgun from the holster cavity in a straight upward motion through the open top of the holster body.

In a preferred embodiment of the present invention there is provided a top-draw security holster wherein the U-shaped latch control means is integrally formed with the holster body and made from the same plastic material.

In a most preferred embodiment of the present invention there is provided top-draw security holster wherein the outer arm is positioned to be engaged by the index finger or by the palm of the user wearing the holster when withdrawing the handgun.

In especially preferred embodiments of the present invention said latch-control means is intended for use in conjunction with the holster described and claimed in U.S. Ser. No. 09/546,506, the teachings of which are incorporated herein by reference and in which there is claimed a rigid plastic hand gun clip-on holster, comprising a rigid plastic holster having inner dimensions complementary to the configuration of the outer sections of a hand gun to be placed therein, wherein said holster is a product of injection molding and wherein said holster further comprises a retention member for mounting said holster on the upper rim of the user's pants, wherein said retention member has a lateral step configuration along the longitudinal axis thereof, whereby said step forms a ledge that can underride a belt, and wherein the ledge of said step further comprises at least two spacedapart upwardly extending flanges for hooking against the front surface of said belt, whereby said holster and said flanges are located forwardly at the front said of said belt thereby enabling said belt to act as stop means preventing upward movement of said holster, while allowing the quick draw of a gun therefrom.

Yet further embodiments of the invention will be described hereinafter.

In U.S. Pat. No. 5,961,013 Collins describes and claims a top draw security holster designed to prevent an assailant from drawing a handgun from the holster while allowing one wearing the holster to draw the handgun from the holster in a straight and upward motion after easily and quickly moving a latch control to a released position. The holster is made of leather, which is an unsuitable material for the latch catch, which therefore needs to be made by the addition of a metal component. The latch comprises a flexible arm integrally connected to a side wall adjacent to a window in the side wall, and further comprises a boss integrally connected to the arm. In the released position the arm is allowed to be in a relaxed state outwardly extending from the side wall so as to allow insertion of the handgun, or straight and upward removal therefrom. In the latched position, the boss extends through the window and inside the trigger guard preventing handgun removal.

The holster described thus requires the user to execute two consecutive actions to withdraw the weapon.

With reference to his FIG. 4 Collins describes in more detail a procedure for drawing the handgun from the holster. The user applies a thumb against thumb break strap 40 to unsnap such strap from restraining strap 42, and then moves the thumb rearward in a substantially continuous and fluid motion so as to apply pressure to thumb tab 66 and unsnap paddle 48 from its latched position. The substantially rearward motion of the upper end 68 of paddle 48 is indicated by an arrow on the figure. The resulting released position of the paddle 48 allows arm 24 to be in its relaxed state, allowing insertion or withdrawal of the handgun.

In contradistinction thereto, the present invention allows for a quicker draw, and not only because the plastic holster has a much lower coefficient of friction than a leather holster. User withdrawal of the handgun is possible in what can be considered a single action comprising two components—applying pressure to the outer arm of the latch control U while drawing the handgun upwards. There are no straps requiring release. The result is a quicker draw, as will be further elaborated—which in an emergency situation could be the difference between accomplishing a mission and becoming a casualty.

It will thus be realized that the novel security catch of the present invention allows the use of the weapon by its wearer in one instinctive movement. The same hand that grips the butt of the handgun applies pressure to the release catch and pulls the gun out of the holster in one instinctive movement.

Assuming the worst case, that a proximate assailant knows that the gun trigger guard is retained by a catch, and also knows what must be done to release the catch, theft of the weapon is not easily achieved. An assailant trying to steal the gun needs to use both hands—one hand to press the release catch and a second hand to pull out the weapon. Were both hands of the attacker thus occupied, the weapon owner would have an excellent opportunity for self-defense.

While all the embodiments of the holster of the present invention can be manufactured at a cost which is barely affected by the security catch, the embodiment seen in FIG. 4 will be of particular interest in this regard.

Although the illustrated example holster is intended for use of right-handed persons, it is to be understood that a holster providing exactly the same advantages will also be produced configured for use of left-handed users.

Full constructional details of the holster body were given in our previous patent and are not repeated in the present specification.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EXEMPLARY EMBODIMENTS

Figure 1:
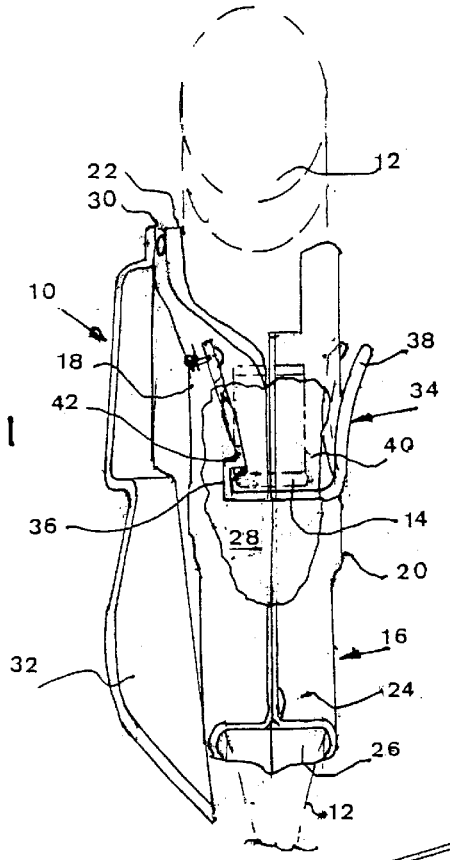
FIG. 1 is an end view of a preferred embodiment of the holster according to the invention, part of the back wall being fragmented to reveal inner details.
Figure 2:
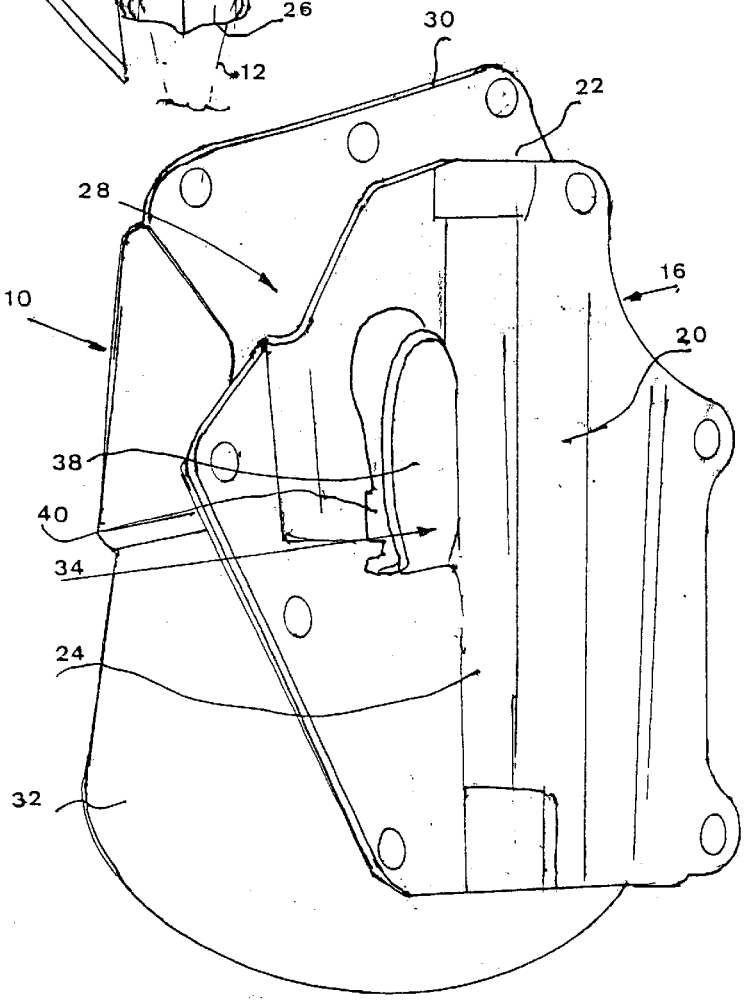
FIG. 2 is a perspective view of the same embodiment.

There is seen in FIGS. 1 and 2 a top-draw security holster 10 for a handgun 12 having a trigger guard 14. The security holster 10 is orientated for wearing by a user. The holster can suitably be made of a high-density thermoplastic grade of polyurethane. This material has outstanding flex life, cut resistance and abrasion resistance.

The holster body 16 has an inner 18 and an outer 20 side wall, an open top 22, a back 24 and an at least partially-closed and non-opening front 26. A holster cavity 28 is defined in the holster body 16. Attached to the holster body 16 at an upper edge 30 is a retention member 32 which enables mounting the holster on the upper rim of a user's pants (not shown).

The holster body 16 supports a flexible U-shaped latch control means 34 having an inner arm 36 and an outer arm 38 bracketing a trigger guard receiving area 40 of the holster cavity 28. The inner arm 36 is provided with an integral boss 42. The U-shaped latch control means 34 in the present embodiment is formed from a stainless steel strip. The U-shaped latch control means 34 is molded together with or riveted to the holster inner side wall 18.

In the relaxed state, the latch control means 34 extends into the trigger guard cavity of a handgun 12 inserted in the holster cavity 28, preventing drawing the handgun 12 therefrom. The outer arm 38 projects outwardly from the outer side wall 20 of the holster body 16. Movement of the outer arm 38 as result of pressure applied thereon by a user towards the holster in turn moves the inner arm 36 away from the trigger guard 14. This allows drawing of the handgun 12 from the holster cavity 28 in a straight upward motion through the open top 22 of the holster body 16.

With reference to the rest of the figures, similar reference numerals have been used to identify similar parts.

Figure 3A:
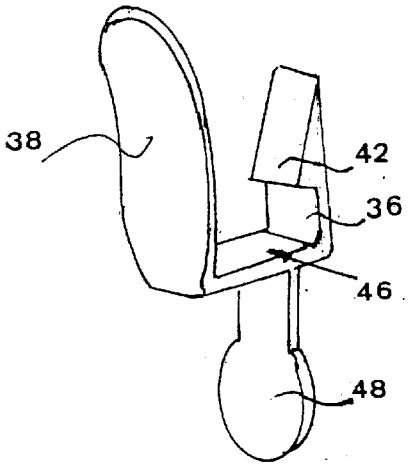
FIG. 3*a* is a perspective view of U-shaped latch control means.
Figure 3B:
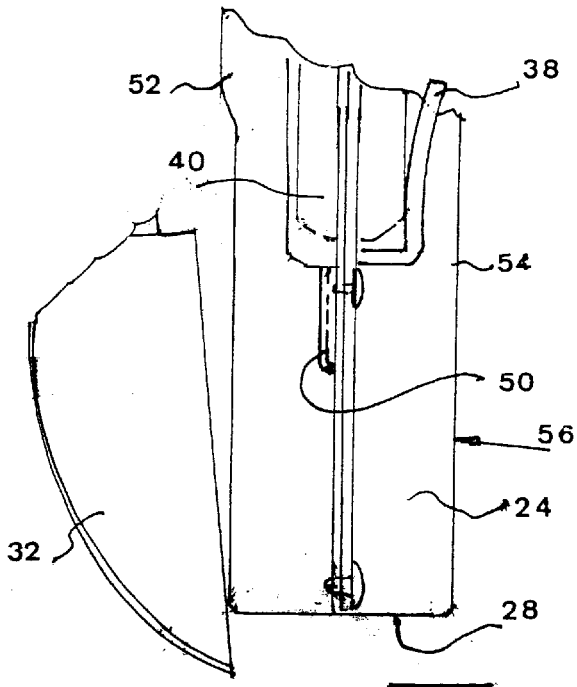
FIG. 3*b* is a side view detail of a retention pocket for the latch control.

Referring now to FIG. 3*a*, there is seen a U-shaped latch control means 46 molded of a unitary strip of flexible plastic. A lower retention boss 48 is rigidly retained in a pocket 50, seen in FIG. 3*b*, formed between the inner side wall 52 and the outer side wall 54 of the holster body 56. The advantage of this arrangement is that latch control means 46 may be molded from a high performance engineering plastic, for example acetal, while the holster body may be molded from a lower cost thermoplastic.

Figure 4:
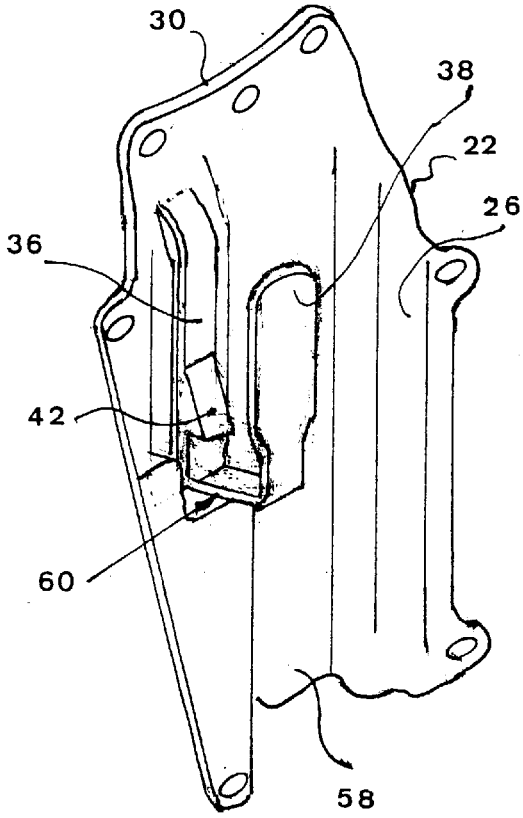
FIG. 4 is a perspective view of a latch control means integrally formed with a side wall.

Seen in FIG. 4 is an inner side wall 58 of a top-draw security holster wherein the U-shaped latch control means 60 is integrally formed with said side wall, and is made from the same plastic material. The manufacturing cost of a holster with the latch 60 is almost the same as its cost without any latch.

Figure 5:
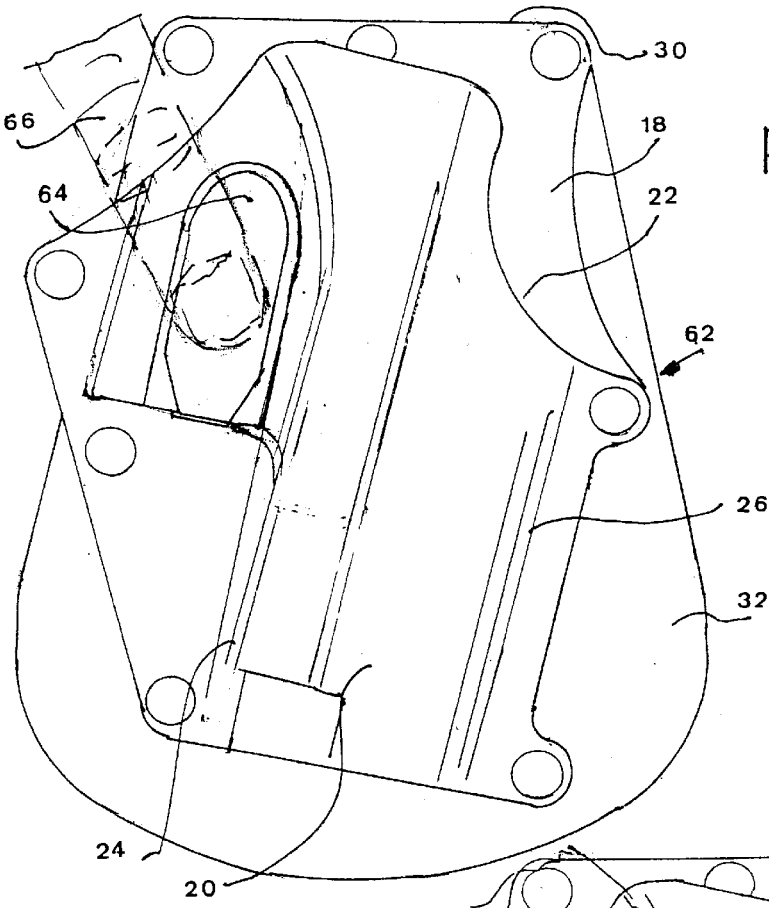
FIG. 5 is an elevational view of an embodiment showing latch release by finger.

Referring now to FIG. 5, there is depicted a top-draw security holster 62 wherein the outer arm 64 is positioned to be engaged by the index finger 66 of the user wearing the holster 62 when withdrawing the handgun 12 seen in FIG. 1.

Figure 6:
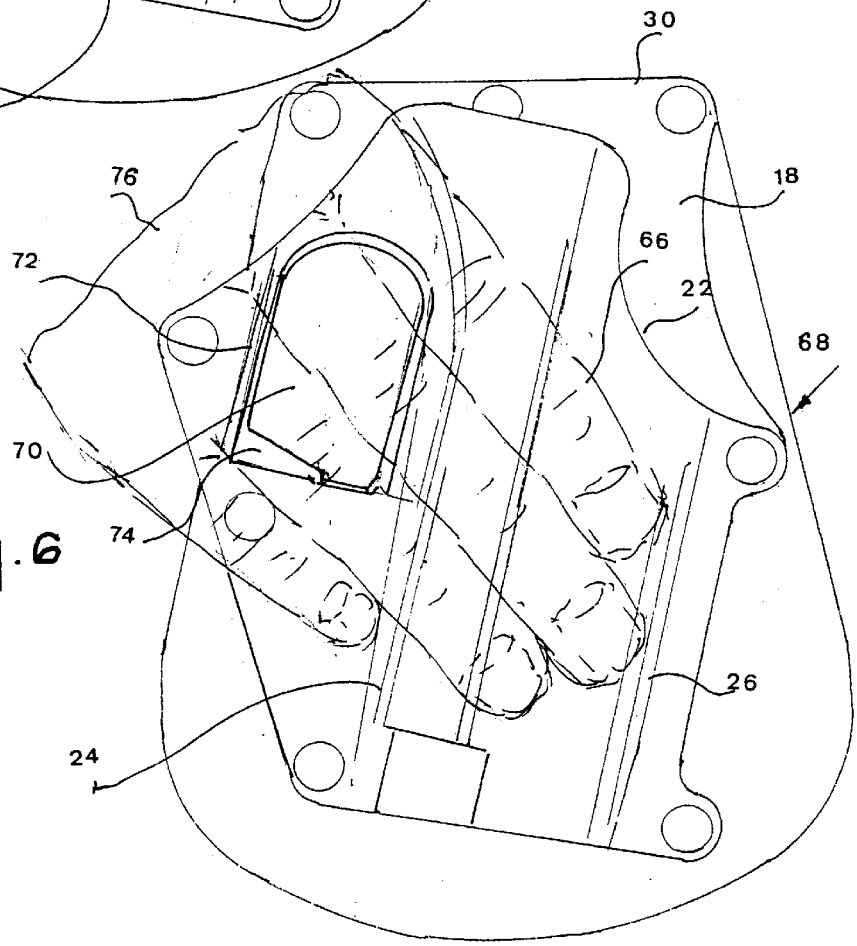
FIG. 6 is an elevational view of an embodiment arranged for latch release by the palm of the user.

FIG. 6 shows a top-draw security holster 68 wherein the outer arm 70 is slightly wider and extends further towards the closed edge 72 of the trigger guard cavity 74 of the holster 68. The outer arm 70 is thus positioned to be engaged by the palm 76 of the user wearing the holster 68 when withdrawing the handgun 12 seen in FIG. 1. This form of catch release may be more convenient for some users than using the index finger 66 alone as seen in the previous figure.

Furthermore, as is known, in the old west of the US one of the terms used to describe the quick drawing of a gun was to "slap leather". As will be realized this term comes from the natural movement of the gunfighter's hand from a relaxed position to an upward sliding movement along the outer surface of the then leather holsters culminated in the withdrawal of the gun from the holster in a single sweeping motion which began with the "slapping of the leather holster".

This embodiment of the present invention envisions the exact same movement of the users hand wherein the palm of the user engages the latch and disengages the same from the trigger guard in said same sweeping motion.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A top-draw security holster for a handgun having a trigger guard of the type wherein the security holster is oriented for wearing by a user and comprises a holster body having an inner and an outer side wall, an open top, a back and an at least partially-closed and non-opening front wherein a holster cavity is defined in said holster body characterized in that said security holster is provided with a flexible U-shaped latch control means made of a unitary strip of flexible plastic having art inner arm and an outer arm bracketing a trigger guard receiving area of said holster cavity, wherein said inner arm is provided with an integral boss, which in the relaxed state of said latch control means extends into the trigger guard cavity of a handgun inserted in said holster body preventing drawing said handgun therefrom and said outer arm projects outwardly from said outer side wall of said holster body, wherein movement of said outer arm towards said holster in turn moves said inner arm away from said trigger guard thereby allowing the drawing of said handgun from said holster cavity in a straight upward motion through the open top of said holster body.

2. A top-draw security holster for a handgun having a trigger guard of the type wherein the security holster is oriented for wearing by a user and comprises a holster body having an inner and an outer side wall, an open top, a back and an at least partially-closed and non-opening front wherein a holster cavity is defined in said holster body characterized in that said security holster is provided with a flexible U-shaped latch control means nude of a unitary strip of flexible plastic having an inner arm and an outer arm bracketing a trigger guard receiving area of said holster cavity, wherein said inner arm is provided with an integral boss, which in the relaxed state of said latch control means extends into the trigger guard cavity of a handgun inserted in said holster body preventing drawing said handgun therefrom and said outer arm projects outwardly from said outer side wall of said holster body, wherein movement of said outer arm towards said holster in turn moves said inner arm away from said trigger guard thereby allowing the drawing of said handgun from said holster cavity in a straight upward motion through the open top of said holster body, said U-shaped latch control means being integrally formed with said holster body and made from the same plastic material.

* * * * *